United States Patent [19]

Baugh

[11] Patent Number: 5,046,895

[45] Date of Patent: Sep. 10, 1991

[54] ROV SERVICE SYSTEM

[76] Inventor: Benton F. Baugh, 14626 Oak Bend, Houston, Tex. 77079

[21] Appl. No.: 460,262

[22] Filed: Jan. 8, 1990

[51] Int. Cl.[5] ..... B63C 11/00

[52] U.S. Cl. ..... 405/188; 405/191

[58] Field of Search ..... 405/185, 188, 190, 191, 405/192; 114/312, 313; 166/335, 338

[56] References Cited

U.S. PATENT DOCUMENTS

| | | | |
|---|---|---|---|
| 3,024,615 | 3/1962 | Aschinger | 405/191 |
| 3,166,123 | 1/1965 | Watkins | 405/191 X |
| 3,222,875 | 12/1965 | Justus | 405/190 |
| 3,543,526 | 12/1970 | O'Neill et al. | 405/188 X |
| 4,010,619 | 3/1977 | Hightower et al. | 405/191 |
| 4,149,818 | 4/1979 | Hettinger et al. | 405/191 |
| 4,906,136 | 3/1990 | Norbom et al. | 405/191 X |

*Primary Examiner*—David H. Corbin

[57] ABSTRACT

An approximately neutrally buoyant system for operations in a subsea environment having a buoyant upper module, a heavy lower module, and multiple connecting members which allows trim stability and extended lifting capacity for the buoyant upper module when the heavy lower module is landed on the ocean floor or available structures.

20 Claims, 3 Drawing Sheets

ROV SERVICE SYSTEM

INFORMATION DISCLOSURE STATEMENT

A formal or paid patent search has not been made with respect to this invention.

U.S. Pat. No. 4,721,055 shows an ROV which uses a single line down to a clump weight for a similar type service.

OTC Paper No. 6044 titled "The Design and Economic Impact of Standardized ROV and Diver Interfaces on Subsea Completion Systems" is attached to give an overview of the need for the interfaces such as are discussed in the specification.

Oil & Gas Journal magazine articles titled "Standardized ROV and driver interfaces will bring surge in subsea capabilities", May 1, 1989, page 49 similarly discusses the subject of interfaces and requirements.

FIELD OF THE INVENTION

The present invention relates the area of subsea floating service systems especially of an ROV (remotely operated vehicle) type and the enhancement of their ability to handle modules of considerable weight.

BACKGROUND OF THE INVENTION

Historically a large number of ROVs (remotely operated vehicles) have been built for subsea service and have a characteristically low ability to pick up useful payloads.

Tasks usually done by the existing remote vehicles are to carry TV cameras for viewing, using complex manipulators to operate small T-Handles on valves, or to attempt simple unplanned repairs. A characteristic inability has existed to pick up useful loads. In some cases, loads are carried by neutrally buoyant ROVs by thrusting up. This has produced the capacity to lift 20-200 lbs. under full upward thrust. This does not provide adequate stability or control to install or remove subsea components. Subsea components can be typically expected to have alignment requirements which imply the need for stability.

One concept has provided a clump weight on a single line to be landed on the ocean floor providing vertical stability and net buoyancy to the ROV itself. No trim stability is provided for that system. The trim is the front to rear elevation of the vehicle. Picking up any load in a manipulator causes a tilting of the trim. System of this type can move the attachment point of the single line and adjust the trim. On a system of this type, when a package is latched onto, the trip adjustment can be made only after the package is separated from the base structure to which it was attached.

SUMMARY OF THE INVENTION

The present invention provides a system for improved servicing of subsea installations with a lower heavy module for stability, and upper positively buoyant module, and two or more lines connecting the two.

The dual lines connecting the heavy module to the positively buoyant module provide a front to back trim stability even when varying loads are picked up or set down at a distance from the center of buoyancy of the positively buoyant module.

A further improvement of the invention is to adjust the length of the lines individually to compensate for the uneven landing of the heavy module on a sloping ocean floor.

A further improvement of the invention is the ability to engage the heavy module with preplanned receptacles on the side of subsea structures.

A further improvement of the invention is that of providing the ability to the heavy module to lock onto subsea structure in a manner not requiring preplanning.

DESCRIPTION OF THE DRAWINGS

FIG. no. 1 is a view of the subsea service system in partial cross section as it would be carrying a replacement module and approaching the subsea equipment installation.

FIG. no. 2 is a view of the lower module of the subsea service system engaged with the lower portion of the subsea equipment installation, and the upper portion of the subsea service system raised to an operational service level.

FIG. no. 3 is a view of the lower module of the subsea service system engaged with the lower portion of the subsea equipment installation by a second means and the replacement module installed on an interface on the subsea equipment installation.

DESCRIPTION OF THE PREFERRED EMBODIMENT

Figure 1:
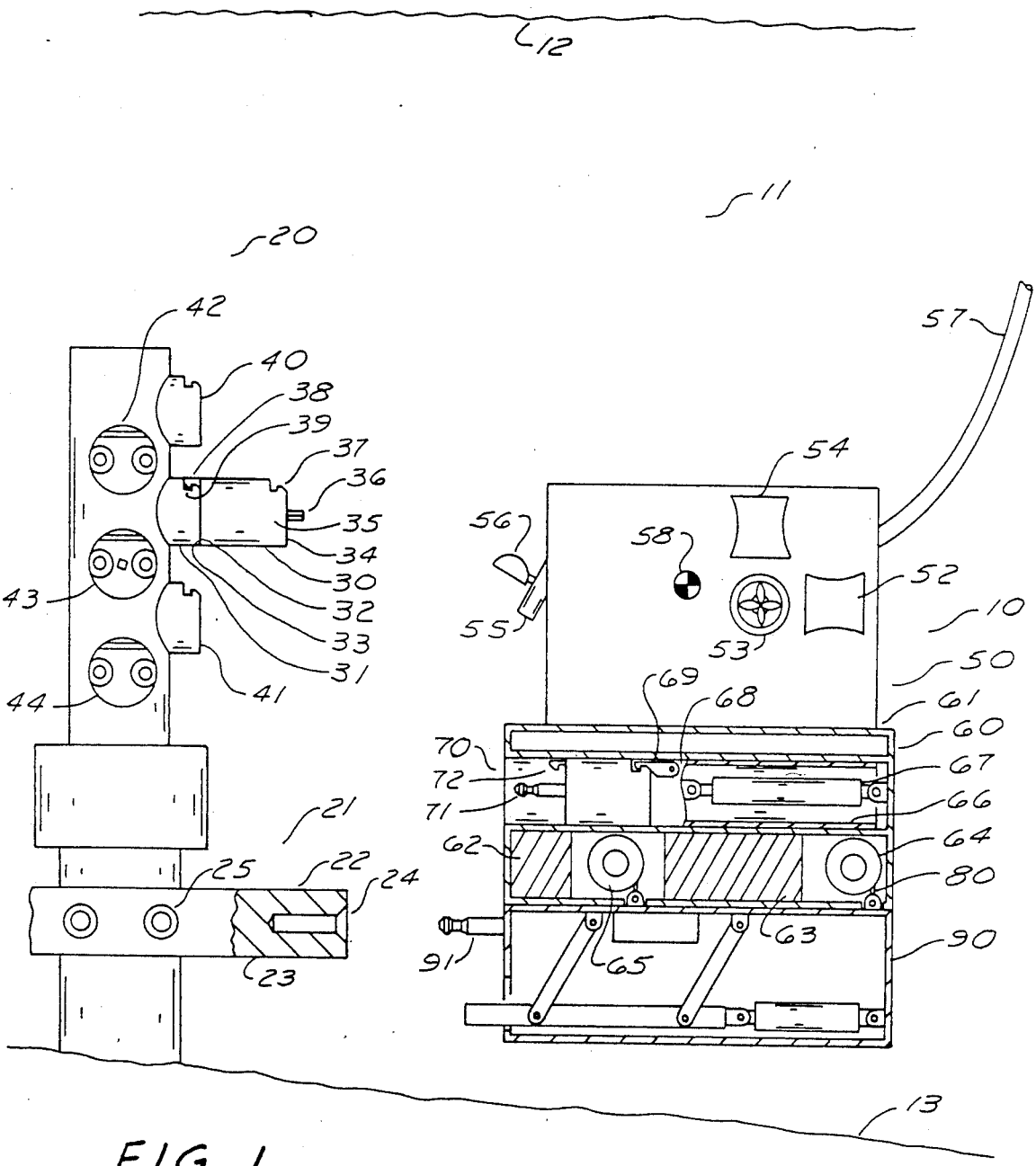
Figure 2:
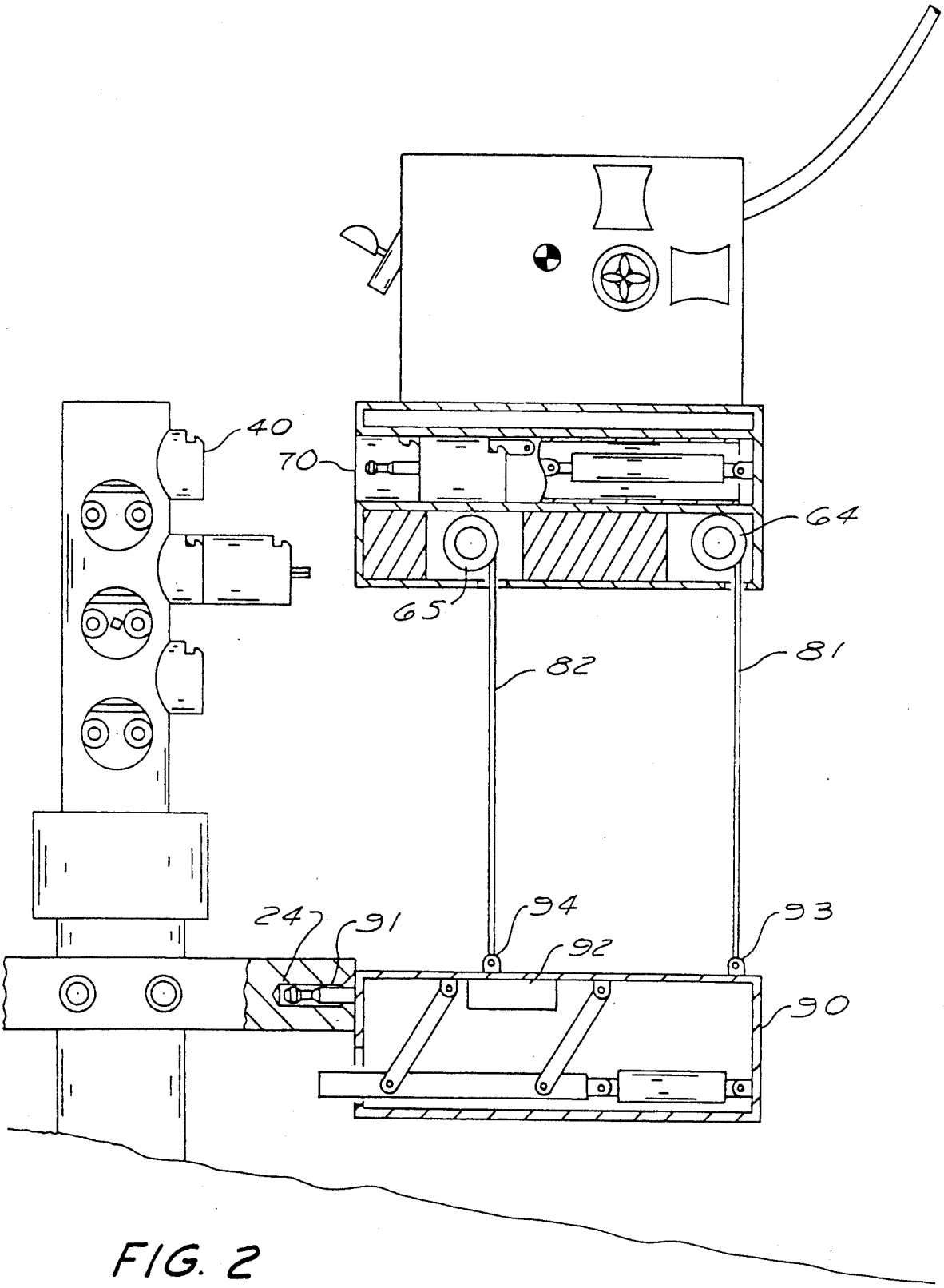
Figure 3:
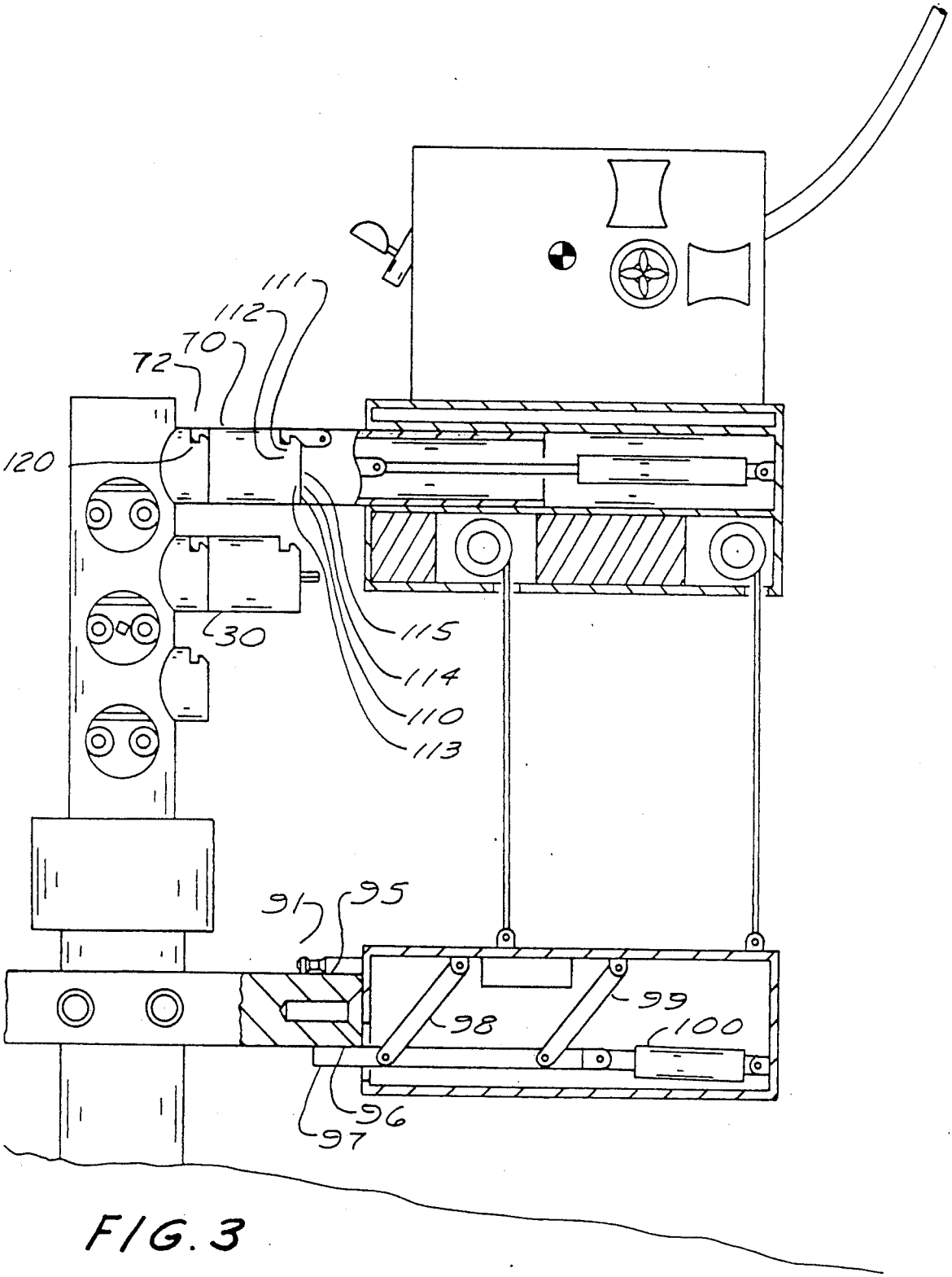

Referring now to FIG. 1, subsea service system 10 is shown in the seawater 11 below the surface of the water 12 and above the ocean floor or mudline 13. In this case the mudline 13 is shown to have a sloping bottom, as frequently occurs.

A subsea equipment installation 20 is shown which might be representative of a subsea completion system (a Christmas tree), a blowout preventer stack, or other grouping of equipment on the ocean floor. A lower structural member 21 typically exists and is typically called a permanent guide structure. In this case upper flat surface 22 and lower flat surface 23 are shown. A pair of receptacles 24 are shown which can be used for docking, as will be discussed later. An additional pair of docking receptacles 25 are shown which will be engaged by the subsea service system 10 when approached from a different direction.

A device 30 is shown on the subsea system 20 to represent any number of subsea components, i.e. gate valves, ball valves, control pods, TFL sensors, temperature sensors, pressure gages, chokes, etc. Landing base 31 provides interface profile 32 to be engaged by interface profile 33 on the device 30. Interface profile 34 allows for engagement of the device 30 by tooling systems. The profile 34 includes dual docking receptacles 35, square stem 36 for a release function, and notch 37. Latch 38 of device 30 is operated by square stem 36 between latched and unlatched positions as it engages or releases from slot 39.

Interface profiles 40 and 41 are similar to profile 33, but are not functional. The purpose of these profiles will be seen in later figures. Profile 42, device 43, and profile 44 are similar to profile 40, device 30, and profile 41, except for being in a different location. As will be noted, they are in general alignment with the docking receptacles 25.

Subsea service system 10 is a combination of upper module 50, connecting members 80, and lower module 90. Upper module 50 is a combination of ROV 51, a tooling package 60, and device 70.

ROV 51 has forward/reverse thruster 52, left/right thruster 53, and up/down thruster 54. Such thrusters are typically propellers on small hydraulic motors. TV cameras 55 and lights 56 are provided for remote visibility of operations. Typically manipulator arms (not shown) which mimic human arms and hands are provided with such ROVs, but are not required in the present operations. ROV 51 has an umbilical 57 to provide power and control signals.

The upper module 50 has a center of buoyancy 58.

Upper module 60 attaches to ROV 51 thru interface 61, blocks of buoyancy material 62 and 63 such as syntactic foam, winches 64 and 65, and an extendable arm 66 which is extendable by a conventional hydraulic cylinder 67. Connector 68 is mounted on extendable arm 66 and is suitable for being moved forward by hydraulic cylinder 67. Latch 69 is mounted on connector 68 for engaging devices such as 70. The latch 69 can be released from devices such as device 70 by a small hydraulic cylinder (not shown) or similar means.

Device 70 is a basic module of construction for carrying assemblies such as gate valves, ball valves, and similar devices to subsea locations for service or replacement. Device 70 includes dual docking pins 71, and a latch 72. In other applications, it might also include hydraulic stab subs or electric connections.

The interface between the device 70 and the connector 68 might well be the same interface which is shown at interfaces 32 and 33.

The subsea service system 10 is shown swimming thru the ocean water toward the subsea equipment installation 20. In the position as shown, the twin support posts 91 will engage the twin receptacles 24 and dock the system.

Support posts and receptacles such as those described in the this specification are presently available in the public domain under the name of the RU (ReUsable) Profiles. This design includes a full range of sizes and torque capacities from 200 ft.—lbs. to 25,000 ft.—lbs. They have been donated to API (American Petroleum Institute) and are being considered to become an API standard.

The subsea service system 10 is approximately neutrally buoyant. Approximately neutrally buoyant is herein defined as having close enough to zero net weight in water that the vertical or up/down thrusters 54 can maintain subsea service system 10 at a subsea elevation. For many of the ROVs presently available, this would imply that the system is neutrally buoyant within 100 lbs. Some ROVs have only a few pounds of vertical thrust capacity, i.e., 10 lbs. If the system needs to handle packages weighing up to 1000 lbs., clearly special considerations need to be taken.

Referring now to FIG. no. 2, the support posts 91 have engaged the receptacles 24 and the subsea service system 10 is docked. After the docking, the winches 64 and 65 were reeled out to pay out cables 81 and 82. Lower module 90 includes attachment points 93 and 94 for cables 81 and 82.

Lower module 90 includes weight material 92 which makes the module relatively heavy in water. The weight of the weight material can be a substantial amount, i.e. 1000 lbs. The composite of the subsea service system 10 is approximately neutrally buoyant. The blocks of buoyancy material 62 and 63 make the upper module 60 and ROV 51 buoyant in the seawater, having a net positive buoyancy.

For this reason, as cables 81 and 82 are payed out by winches 64 and 65, the upper module 60 and ROV 51 are allowed to rise. The ability of the upper module 60 and the ROV 51 to carry a payload is directly proportionate to the net positive buoyancy of the assembly.

In the position as shown, the device 70 is positioned at the same elevation as the interface profile 40 to allow for convenient service operations on the interface profile 40. By operation of the winches 64 and 65, the device can be raised or lowered to the elevation of various interface profiles requiring service operations.

Referring now to FIG. no. 3, an alternate method of docking the lower module 90 with respect to a structural member such as lower structural member 21 is shown. The lower surface 95 of support posts 91 has been landed on the top of upper flat surface 22. Flat surface 96 of plate 97 is prepared to swing on arms 98 and 99 and to contact lower flat surface 23 of lower structural member 21. The movement of plate 97 is controlled by the cylinder 100 thru hoses (not shown) from the ROV 51. When plate 97 is moved forward and loads on lower flat surface 23 of lower structural member 21, a clamping action occurs with sufficient grip to support the weight or net negative buoyancy of the lower module 90.

This clamping action provides a less precise method of docking the lower module 90 with the subsea structures, but a more versatile method as little if any preplanning is required on the structures.

As can be seen in this figure, the connector 68 and the device 70 have been extended forward sufficiently for the device 70 to engage the interface profile 40. In this location, the latch 72 can engage the notch 120 to secure the tool package to the interface profile 40.

At the interface 110 on connector 68 there may also be dual docking pins 111 similar to the dual docking pins 71 for engaging dual docking receptacles 112 on interface 113 which are similar to the dual docking receptacles 35. Interface 110 may also include a wrench socket 114 (not shown) as is well known which will engage a square stem 115 (not shown) which is similar to square stem 36. Wrench socket 114 can be rotated to rotate square stem 115 and to operate the latch 72.

By using this combination of mechanisms, the device 70 can be landed and stored on the interface profile 40. The connector 68 can be retracted by hydraulic cylinder 67 away from the device 70. The weight (or buoyancy) of the device 70 will be landed on the interface profile, and the ROV 51 and upper module 60 will remain in the same position other than minute changes in the stretch in the cables 81 and 82.

By this same procedure, the ROV 51 and upper module 60 can be lowered and the connector 68 aligned with the device 30. For simplicity of understanding a feature of this system, the device 70 can be considered to be an exact replacement of the device 30. Device 30 can be removed from interface profile 33 and reinstalled on interface profile 41.

Then device 70 can be removed from interface profile 40 and installed on interface profile 33. Then device 30 can be retrieved from interface profile 41, upper module 60 lowered and landed on lower module 90, lower module released from the lower structural member 21, and the entire subsea service system 10 returned to the surface.

By following this procedure, many components on a subsea installation will be able to be repaired by using a replacement method.

When a subsea service system needs to handle with stability components with net weight in water and install or remove them within subsea structures, the weight which can be handled is proportionate to a first horizontal distance from the rear cable 81 to the center of buoyancy 57 and is inversely proportionate to a second horizontal distance to the center of the weight in front of the rear cable 81. When the product of the weight times the second horizontal distance exceeds the product of the buoyancy times the first horizontal distance, the front of the ROV 51 and upper module 60 will begin to dip and position control is lost.

For this reason, the rear cable 81 is advantageously located as far to the rear of the assemblies as possible to improve the magnitude of the weight which can be handled, and the distance to which the weight can be extended.

For most stable operations, the front cable 82 should be located at or in front of the center of buoyancy 57.

By using this method, components of relatively high weight, i.e. 1000 lbs., can be conveniently handled by a free swimming ROV system, thereby greatly increasing the serviceability of the subsea installations.

Additionally, the front cable 82 can be a pair of cables placed on each side of the centerline of the system and give an increased lateral stability to the system.

The foregoing disclosure and description of this invention are illustrative and explanatory thereof, and various changes in the size, shape, and materials, as well as the details of the illustrated construction may be made without departing from the spirit of the invention.

I claim:

1. A system for the replacement of components in a subsea environment comprising an upper module, a lower module, a tooling package, and module connecting means, said system having the ability for providing a vertical force and having a net buoyancy, said vertical force exceeding said net buoyancy in a manner as to allow said system to move vertically when subsea or maintaining a constant subsea elevation, said lower module being negatively buoyant, providing engagement means to a subsea structure, said upper module being positively buoyant, having a center of buoyancy, supporting said tooling package, and having a front side, said tooling package having the ability to move from a retracted position adjacent said upper module to an extended position on said front side to engage a device mounted on a subsea structure, the ability to release said device from said subsea structure, the ability to remove said device from said subsea structure, said module connecting means comprising two or more flexible and extensible members with a first of said flexible and extensible members being at or in front of said center of buoyancy and a second of said flexible and extensible members being behind said center of buoyancy, such that when said engagement means are engaged with said subsea structure and said first flexible and extensible member is extended to a first length and said second flexible and extensible member is extended to a second length, said upper module has a horizontal trim, and further such that when said tooling package is extended to the front a first distance said trim is not changed, and further such that when said device is removed from said subsea structure and the weight of said device is supported by said tooling package at said first position said trim is not changed, the magnitude of the weight of the device which can be carried without changing said trim being generally proportionate to the magnitude of said net buoyancy of said upper module and to the distance behind said center of buoyancy of said second flexible and extensible member and inversely proportionate to the distance said device is in front of said second flexible and extensible member.

2. A system for the replacement of components in a subsea environment comprising an upper module, a lower module, a tooling package, and module connecting means, said system having vertical and horizontal thrust capacity, said system being approximately neutrally buoyant, said lower module being negatively buoyant, said upper module being positively buoyant, having a center of buoyancy, supporting said tooling package, and having a front side, said module connecting means comprising two or more flexible and extensible members with a first of said flexible and extensible members being near or in front of said center of buoyancy and a second of said flexible and extensible members being behind said center of buoyancy, such that when said lower module is supported in a stationary position and said first flexible and extensible member is extended to a first length and said second flexible and extensible member is extended to a second length, said upper module has a horizontal trim, said tooling package having the ability to move from a retracted position adjacent said upper module to an extended position on said front side of said upper module, said extended position being in front of said first flexible and extensible member, and further such that when said tooling package is extended to the front to said extended position said horizontal trim is not changed.

3. The invention of claim 2, wherein said tooling package can engage a device mounted on a subsea structure, can release said device from said subsea structure, and can remove said device from said subsea structure.

4. The invention of claim 3, wherein said device has a weight and when said device is removed from said subsea structure and said weight of said device is supported by said tooling package said horizontal trim is not changed.

5. The invention of claim 4, wherein the magnitude of said weight of said device which can be carried without changing said horizontal trim is proportionate to the magnitude of said net buoyancy of said upper module and inversely proportionate to the distance said device is in front of said second flexible and extensible member.

6. The invention of claim 5, wherein said lower module is supported in said stationary position by being landed on the ocean floor.

7. The invention of claim 6, wherein said lower module is provided with one or more support posts which are suitable for insertion into receptacles and is supported in said stationary position when said one or more support posts are inserted into said receptacles.

8. The invention of claim 7, wherein said support posts and said receptacles are of the design known as the RU (ReUsable) Profile.

9. The invention of claim 8, wherein said lower module is provided with one or more clamping means suitable for locking onto available subsea structures for the purpose of supporting said lower module in said stationary position.

10. A system for the operations in a subsea environment comprising an upper module, a lower module, and module connecting means, said system having vertical and horizontal thrust capacity, said system being approximately neutrally buoyant, said lower module being negatively buoyant, said upper module being positively buoyant, having a center of buoyancy, and having a front side, said module connecting means comprising two or more flexible and extensible members with a first of said flexible and extensible members being near or in front of said center of buoyancy and a second of said flexible and extensible members being behind said center of buoyancy, such that when said lower module is supported in a stationary position and said first flexible and extensible member is extended to a first length and said second flexible and extensible member is extended to a second length, said upper module has a horizontal trim.

11. The invention of claim 10, wherein said upper module supports a tooling package.

12. The invention of claim 11, wherein said tooling package has the ability to move from a retracted position adjacent said upper module to an extended position on said front side of said upper module, said extended position being in front of said first flexible and extensible member.

13. The invention of claim 12, wherein such that when said tooling package is extended to the front to said extended position said horizontal trim is not changed.

14. The invention of claim 13, wherein said tooling package can engage a device mounted on a subsea structure, can release said device from said subsea structure, and can remove said device from said subsea structure.

15. The invention of claim 14, wherein said device has a weight and when said device is removed from said subsea structure and said weight of said device is supported by said tooling package said horizontal trim is not changed.

16. The invention of claim 15, wherein the magnitude of said weight of said device which can be carried without changing said horizontal trim is proportionate to the magnitude of said net buoyancy of said upper module and inversely proportionate to the distance said device is in front of said second flexible and extensible member.

17. The invention of claim 16, wherein said lower module is supported in said stationary position by being landed on the ocean floor.

18. The invention of claim 17, wherein said lower module is provided with one or more support posts which are suitable for insertion into receptacles and is supported in said stationary position when said one or more support posts are inserted into such receptacles.

19. The invention of claim 18, wherein said support posts and said receptacles are of the design known as the RU (ReUsable) Profile.

20. The invention of claim 19, wherein said lower module is provided with one or more clamping means suitable for locking onto available subsea structures for the purpose of supporting said lower module in said stationary position.

* * * * *